US007252207B2

(12) United States Patent
Liao

(10) Patent No.: US 7,252,207 B2
(45) Date of Patent: Aug. 7, 2007

(54) LINER SUPPORT FOR A CONTAINER SUCH AS A GARBAGE CAN

(76) Inventor: Samson S. C. Liao, 12 Turning Mill Rd., Sharon, MA (US) 02067

( * ) Notice: Subject to any disclaimer, the term of this patent is extended or adjusted under 35 U.S.C. 154(b) by 0 days.

(21) Appl. No.: 10/304,984

(22) Filed: Nov. 26, 2002

(65) Prior Publication Data

US 2003/0098309 A1 May 29, 2003

Related U.S. Application Data

(60) Provisional application No. 60/333,539, filed on Nov. 27, 2001.

(51) Int. Cl.
*B65F 1/06* (2006.01)

(52) U.S. Cl. ..... 220/495.11; 220/908.1

(58) Field of Classification Search ..... 220/9.4, 220/495.06, 495.1, 495.11, 908.1
See application file for complete search history.

(56) References Cited

U.S. PATENT DOCUMENTS 1,692,287 A * 11/1928 Bundy ..... 220/254.2
1,736,192 A * 11/1929 Easton ..... 220/495.08
1,964,513 A * 6/1934 Hammer ..... 220/254.2
4,577,778 A * 3/1986 Kim ..... 220/495.07
4,623,111 A * 11/1986 Prader ..... 248/97
4,705,246 A * 11/1987 Wolf ..... 248/97
4,901,959 A * 2/1990 Stage ..... 248/97
5,478,152 A * 12/1995 Bogle ..... 383/33
5,816,431 A * 10/1998 Giannopoulos ..... 220/495.11
5,971,194 A * 10/1999 Freedland ..... 220/495.08

* cited by examiner

*Primary Examiner*—Stephen J. Castellano
(74) *Attorney, Agent, or Firm*—Mintz, Levin, Cohn, Ferris, Glovsky and Popeo, P.C.; A. Jason Mirabito; David F. Crosby

(57) ABSTRACT

This invention relates to an internal support or support frame for a liner used to protect the inside surface of a container from coming in contact with the contents to be deposited therein. For example, garbage can liners are provided to protect the inside surfaces of garbage cans from coming in contact with and thus contaminated by the garbage that is deposited and stored therein. The internal support or support frame provides that the liner is contained entirely within the container, without having to lap or drape over the exterior of the container. This eliminates a problem associated with using plastic liners draped over the outside of containers such as garbage cans that usually result in an unsightly situation, especially in the case of decorative trash cans.

10 Claims, 15 Drawing Sheets

LINER SUPPORT FOR A CONTAINER SUCH AS A GARBAGE CAN

CROSS-REFERENCE TO RELATED APPLICATIONS

This application claims the benefit of priority to U.S. Ser. No. 60/333,539 filed Nov. 27, 2001, which is incorporated herein by reference in its entirety.

STATEMENT REGARDING FEDERALLY SPONSORED RESEARCH

Not Applicable

Reference to Microfiche Appendix

Not Applicable

BACKGROUND OF THE INVENTION

1. Field of the Invention

This invention relates to an internal support frame for supporting a liner, such as a plastic garbage bag, in a container such as a garbage can. The support frame supports the liner in a manner such that the liner is contained entirely within the container, without having to lap over the exterior of the container.

2. Description of the Prior Art

Plastic garbage bags are a consumer product typically used as an inner liner to prevent the interior of garbage cans or containers from being contaminated by the garbage. The bags also facilitate easy removal, storage and dumping of the garbage.

A problem with using plastic liners is that they typically have to be lapped over the outside of the top of the container, and derive their support from the relatively rigid container, as in FIG. 1. This results in an unsightly situation, especially in the case of decorative containers and garbage cans.

One known solution to this unsightly situation is to provide a rigid container that fits within the garbage can. This type of inside rigid container is basically a garbage can within a garbage can. The inside container has a bottom and solid walls like the outside container and the shape of the inside container is the same as the overall general shape of the outside garbage can, i.e. if the garbage can is square or circular, the inside container is respectively also square or circular. This type of inside container is usually used in commercial or industrial locations, or as public garbage cans on streets or train stations. The fact that these are usually not for domestic use is because this system is a relatively high cost system.

Another related device that is available is a laundry hamper consisting of a frame used to hold a cloth bag that then can be used to hold laundry. The frame is usually used as a stand alone application, i.e. not inserted into another container. Some of these frames (e.g. in hospital applications, or used to hold large quantities of towels in a gym or poolside, i.e. by a swimming pool) are often on wheels, and the cloth bag is usually attached to the frame and not removable. In any case, the frame, with its related assemblies, is usually fairly rigid and is designed to support the full weight of the bag plus the contents without any outer container or supporting structure.

It is one object of the present invention to provide an apparatus, which supports a liner for a container without the liner extending over the outside of the container.

It is another object of the present invention to improve the unsightly appearance of containers by providing a means to support a liner with the container.

SUMMARY OF THE INVENTION

The present invention includes a liner support element, such as a frame, which can be made of any suitable material, that is adapted to fit inside a container such as a garbage can or a container for bulk foodstuffs. The dimensions of the frame are selected to enable the frame with the open end of the liner lapped over the frame to fit discretely within the container in order to support the liner in a position to protect inside surface of the container from coming in contact with the material that is intended to be deposited in the container. The frame can be fabricated by any known method or material. In accordance with the invention, the container can be provided with an interior sleeve, clips, lip, ridge, protrusion, or other shape or device which is adapted to support the frame at a predetermined position with respect to the top edge of the container, and in some instances without requiring legs to support the frame. The invention with the plastic liner installed is preferably intended to fit entirely within the interior of the container, and thereby eliminating the unsightly exterior overlap of the liner. The invention has utility and economic advantages over what exits in the prior art.

With regard to certain embodiments of the present invention, the frame need only support the weight of the liner, but not the weight of any contents (such as trash, foodstuffs or laundry) within the liner. The weight of the contents is supported by the bottom of the liner which is supported by the bottom of the container, so that the weight of the contents is resting on the bottom of the container and not the liner support frame of the present invention. In one embodiment, the present invention can be used with a bottomless container, where the bottom of the liner rests on the floor or the ground.

BRIEF DESCRIPTION OF THE DRAWINGS

The foregoing and other objects of this invention, the various features thereof, as well as the invention itself, may be more filly understood from the following description, when read together with the accompanying drawings in which.

DETAILED DESCRIPTION OF THE PREFERRED EMBODIMENTS

In the figures, the container shown is a garbage can that can have a circular in shape; this is for illustrative purposes only in order to facilitate further understanding of the present invention. The invention can be embodied in a frame adapted to fit within any container and the container can be any shape: circular square, rectangular, elliptical, and irregularly shaped. In addition the sides of the container do not have to be exactly 90 degrees to the ground, the sides of the container can be sloped or arbitrarily shaped with bulges, etc. Further, the top edge of the container forming the opening need not be the distance from the bottom of the container and select areas of the top edge along the opening can be higher or lower than other areas.

Figure 1:
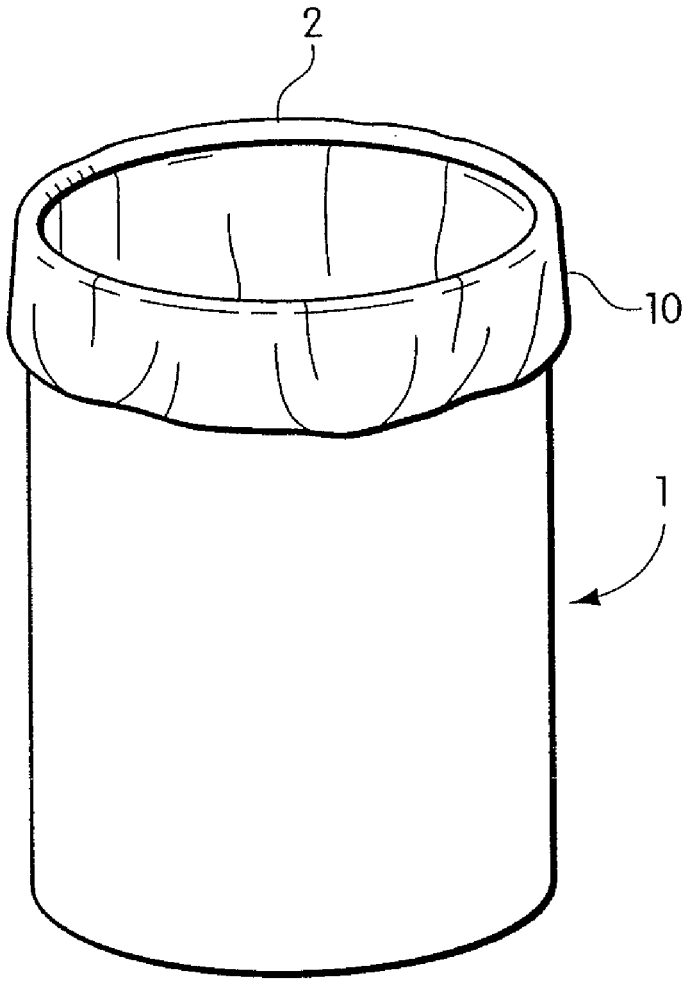
Fig. 1 PRIOR ART
FIG. 1 shows a garbage can and liner in the prior art.

FIG. 1 shows a container 1 for holding garbage in the prior art and which it is common for installing a plastic bag as a liner 2 for the garbage can, where the top end of the plastic bag is lapped or draped 10 over the top of a garbage can. This results in an unsightly application, especially for garbage cans with a decorative intent.

Figure 2:
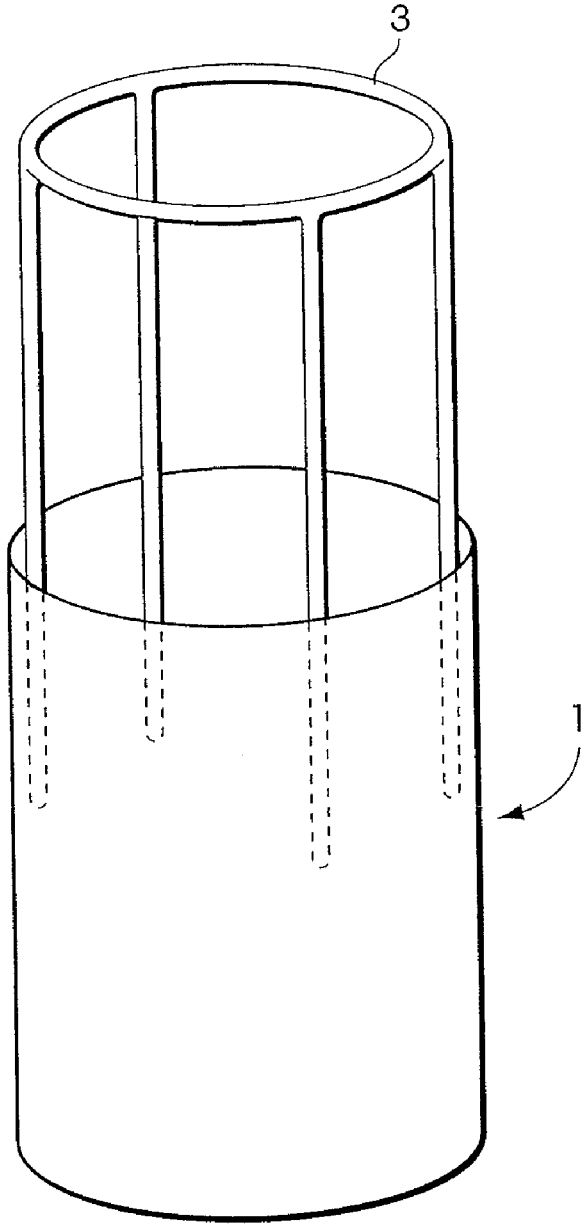
FIG. 2 shows a liner support and a container in accordance with the present invention.

FIG. 2 shows a liner frame 3 designed and fabricated to fit within the garbage can 1. In this figure, note that the liner frame 1 has three legs, however, any number of which can be selected to provide even support of the liner frame. While three legs provide a minimum of support, more legs can be provided. Alternatively, the liner support frame 3 can be formed of a cylindrical tube or sleeve, which is selected of the appropriate dimensions to support the liner adjacent the top edge of the garbage can.

Figure 3:
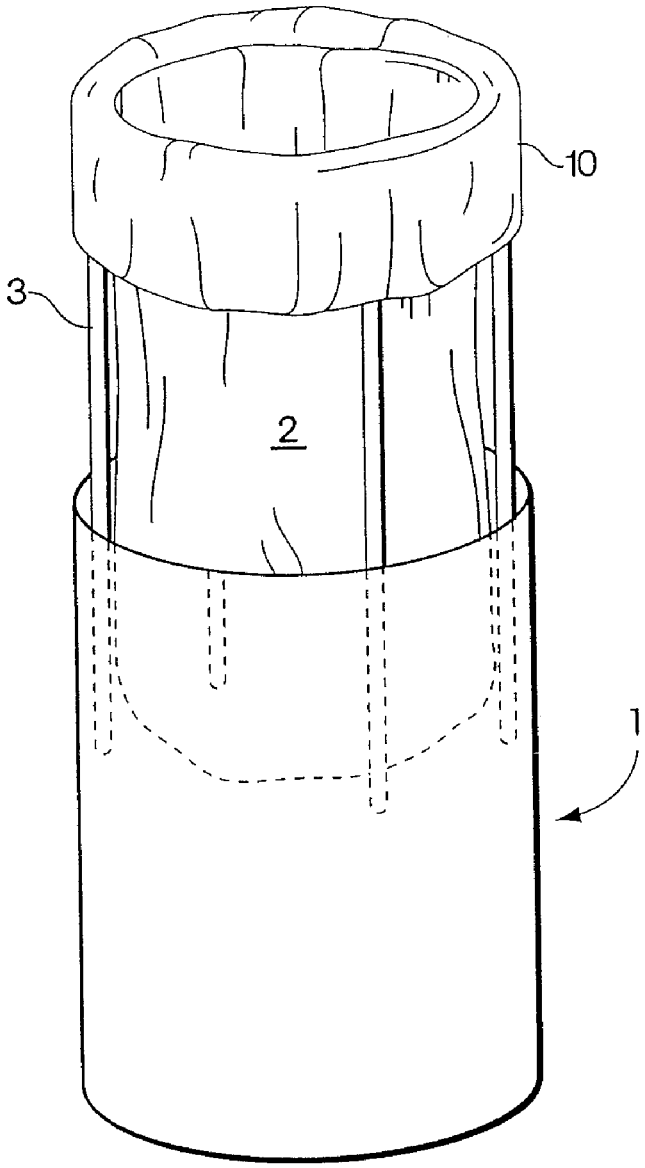
FIG. 3 shows the liner support with the liner installed over the frame, just prior to full insertion into the container in accordance with the present invention.

FIG. 3 shows the liner frame 3 with the plastic garbage liner 2 installed over the frame, just prior to full insertion into the garbage can container.

Figure 4:
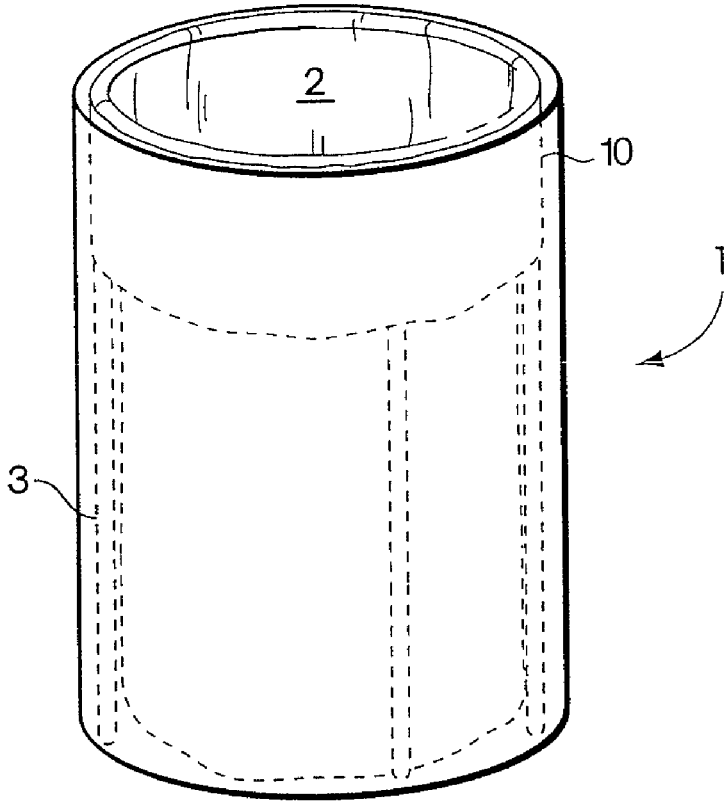
FIG. 4 shows the liner support with the liner installed into the container in accordance with the present invention.

FIG. 4 shows the liner frame 3 with the plastic garbage liner 2 installed over the frame 3, with full insertion into the garbage can container 1. Contrast this with FIG. 1, and notice the increase that can result in aesthetic value.

Figure 5:
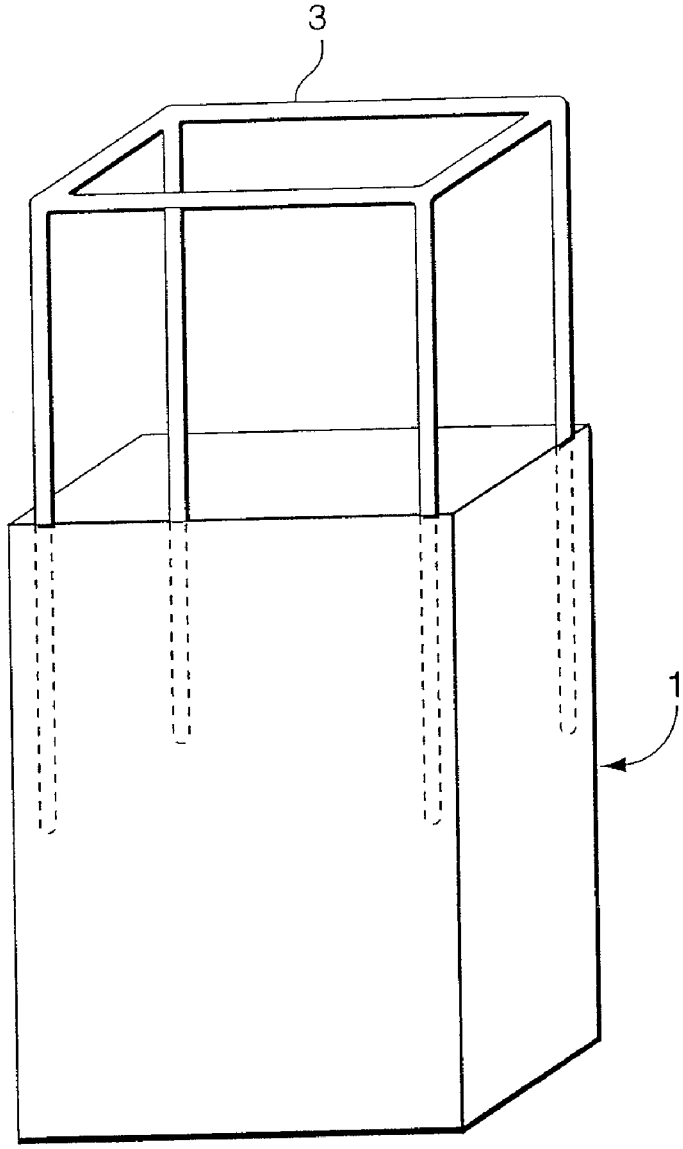
FIG. 5 shows an alternate embodiment of the present invention where the container and the liner support are square.

FIG. 5 shows a variation of the liner frame 3 where the garbage can 1 is square with straight sides perpendicular to the ground. This is to show an alternative application of the present invention that can be implemented.

Figure 6:
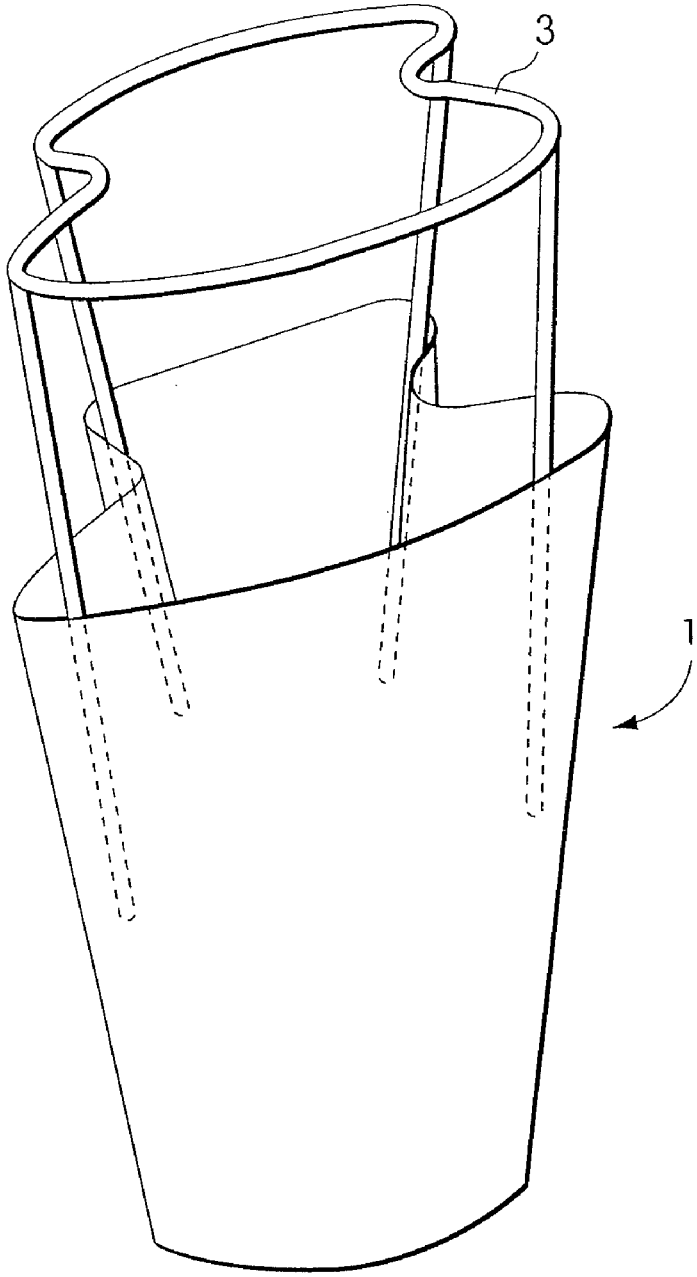
FIG. 6 shows an alternate embodiment of the present invention where the container and the liner support have an irregular shape.

FIG. 6 shows a variation of the liner frame 3 where the garbage can 1 has an irregular shaped opening and where the slanted sides are not perpendicular to the ground. This illustrates how the liner support frame can be customized for almost any shape of garbage can 1.

Figure 7A:
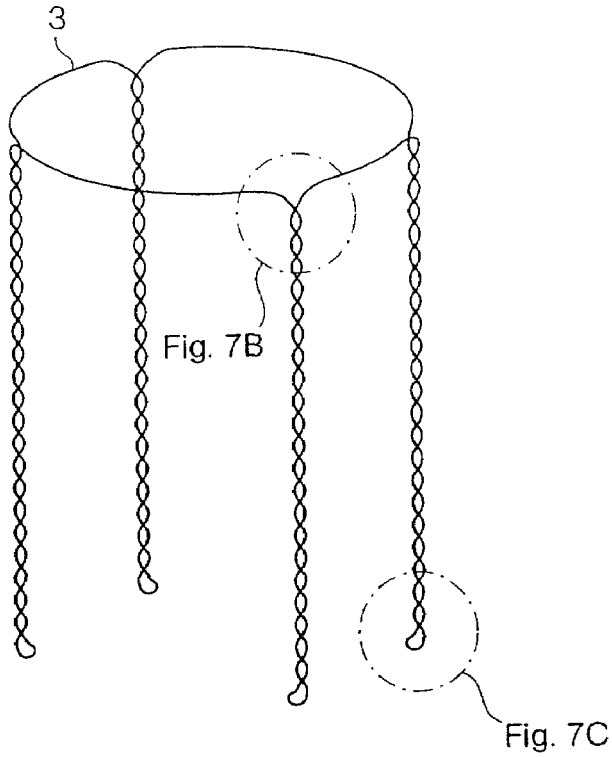
FIG. 7 shows an alternate embodiment of the present invention for a custom application, wherein liner support is fabricated using metal wire or plastic coated wire.
Figure 7B:
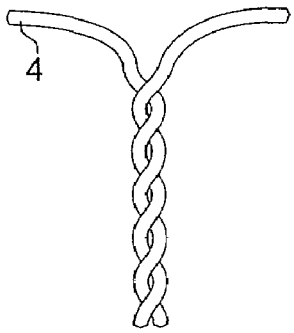
Figure 7C:
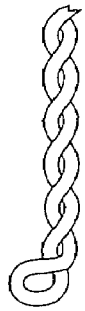

FIG. 7 shows one preferred fabrication method for a liner frame 3 using a wire material, such as, for example, metal wire or plastic coated wire as the material with the most adaptability for customization to any shape of garbage can. Preferably, the wire can be No. 8 AWG copper or steel wire. Typically, the material can be solid with a round cross-section, however, any cross-section (for example, oval, square, rectangular or hexagonal, can be used. In addition, the material can be hollow or tubular.

The method of fabrication can include cutting an appropriate measured lengths of wire, bending the wire 4 at locations to result in 3 to 4 segments that will result in the appropriate top shape. Then the segments of the wire 4 to be used in forming the legs can be twisted together to keep the frame together. Twisting together the wire 4 also gives the legs added rigidity to support the frame and the garbage bag, and so that the wire 4 does not buckle.

At the bottom of the legs, the pair of combined twisted wires is bent up backwards upon itself, so that the sharp edges of the cut wire do not cause scratches of the bottom of the garbage or perforation of the plastic liner, or injury to persons using the device. Alternatively, a screw cap, such as an electrical wire connector cap or similar cap can be used and screwed or adhered or fitted and held by frictional forces at the base of the legs to achieve the same purpose.

Figure 8:
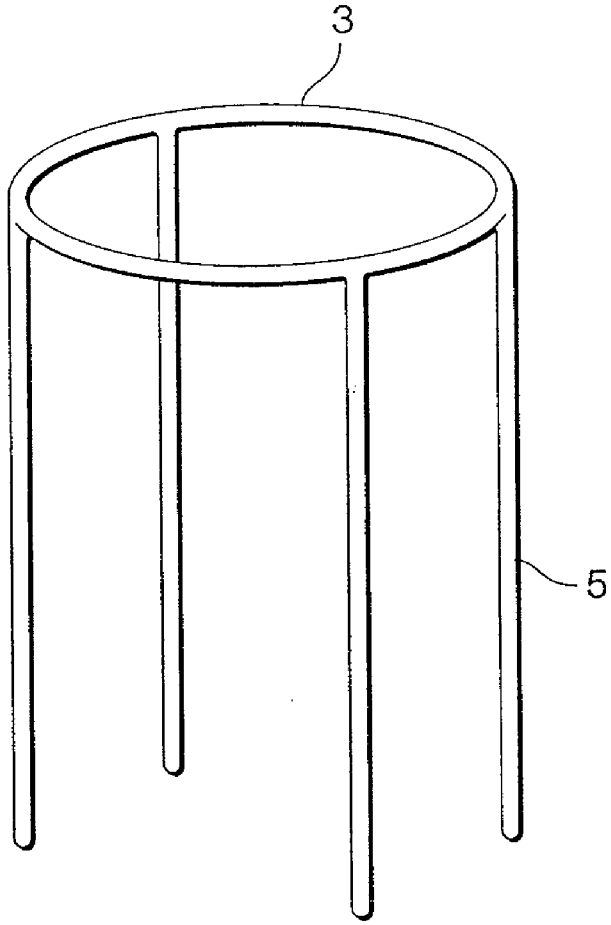
FIG. 8 shows an alternate embodiment of the present invention where the frames and the legs can be solid metal or plastic rods or hollow metal or plastic rods.

FIG. 8 shows an alternative embodiment of the liner frame 3, where and the legs 5 (and frame) can be solid metal or plastic rods or hollow metal or plastic rods, where the rods can have any cross-sectional shape, e.g. circular, square, elliptical, etc., and where the legs can be securely fastened, such as by either arc welding or heat welding to the top element of the frame. This method can be used for mass production of a standard frame, rather than the customized frame shown in FIG. 7. This method can also be used to produce a customized frame, but the costs may be higher than the method shown in FIG. 7.

Figure 9A:
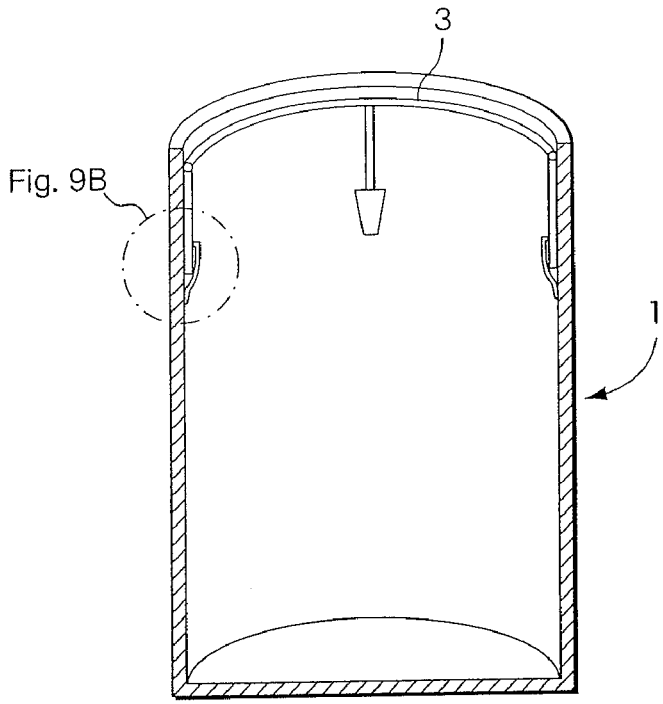
FIG. 9 shows an alternate embodiment (cross-sectional view of the container) of the present invention where the liner support (ring) is supported on relatively short legs that are secured by clips fabricated and attached to the inside of the container, in accordance with the invention.
Figure 9B:
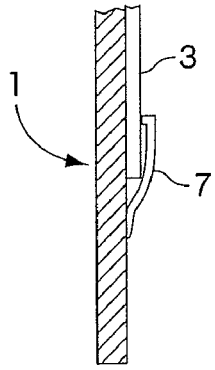
Figure 10A:
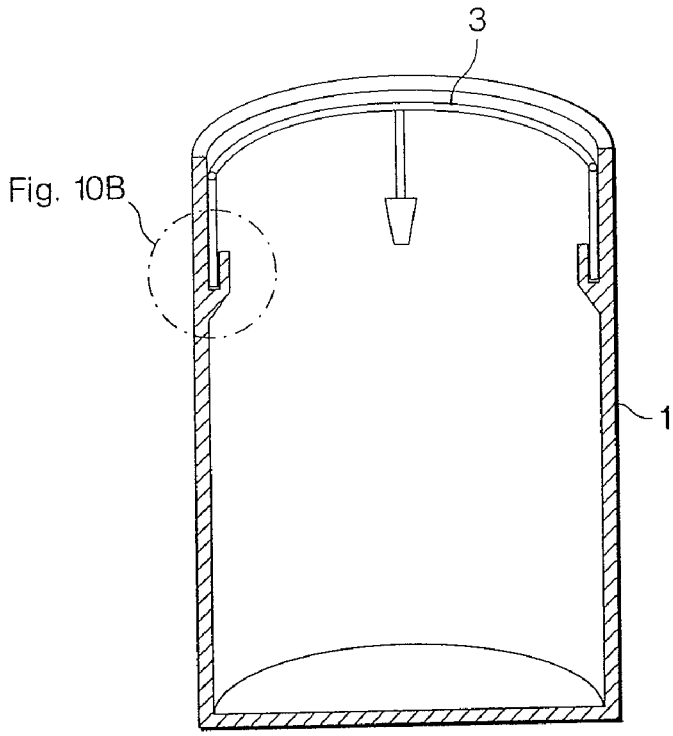
FIG. 10 shows an alternate embodiment (cross-sectional view of the container) of the present invention where the liner support (ring) is supported on relatively short legs that are inserted into a inside sleeve or pocket fabricated as part of the container, in accordance with the invention.
Figure 10B:
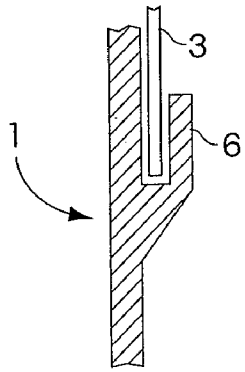
Figure 11A:
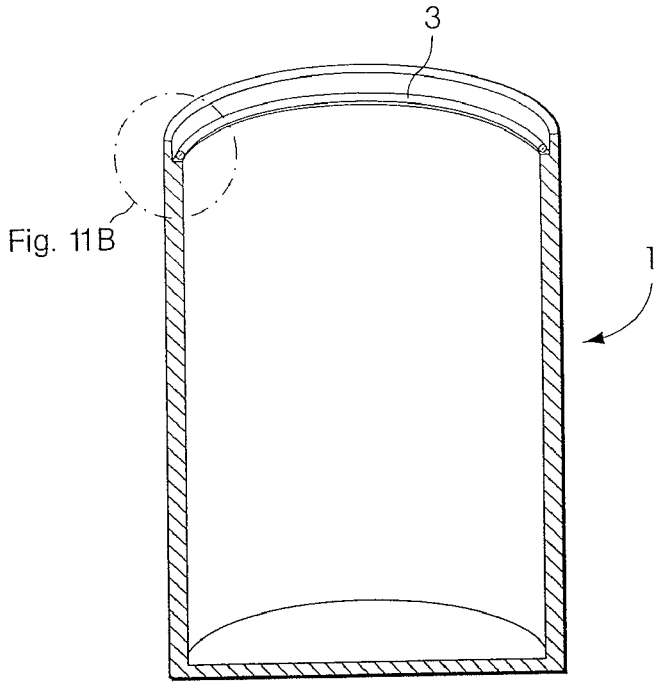
FIG. 11 shows an alternate embodiment (cross-sectional view of the container) of the present invention where the liner support (ring) has no legs and is supported on an inside lip or ridge fabricated as part of the container, in accordance with the invention.
Figure 11B:
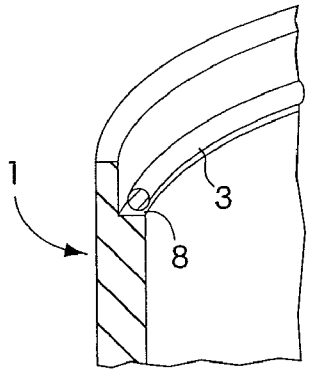
Figure 12A:
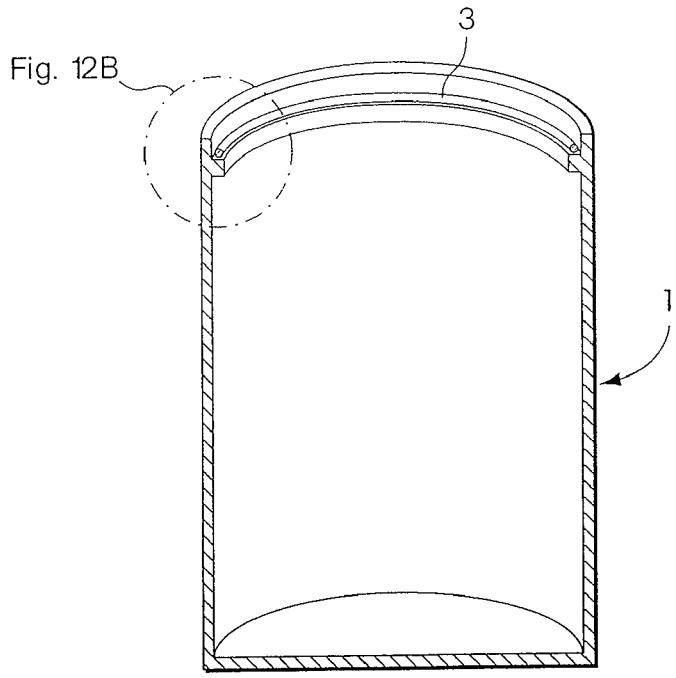
FIG. 12 shows an alternate embodiment (cross-sectional view of the container) of the present invention where the liner support (ring) has no legs and is supported on an inside protrusion fabricated as part of the container, in accordance with the invention.
Figure 12B:
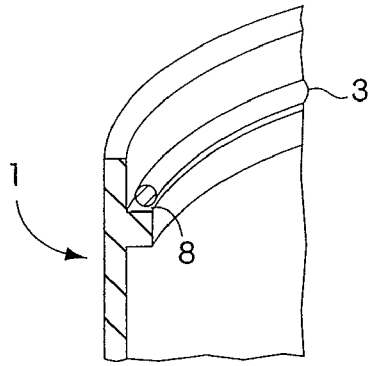
Figure 13A:
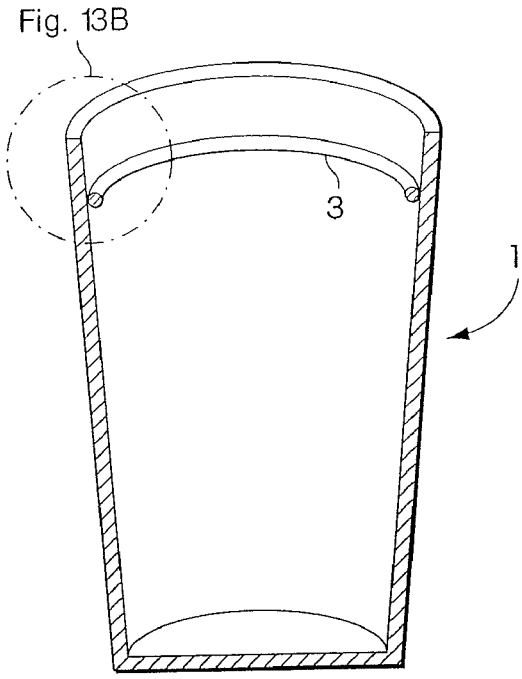
FIG. 13 shows an alternate embodiment (cross-sectional view of the container) of the present invention where the liner support (ring) has no legs and is supported by the constriction of the tapered shape of the container, in accordance with the invention.
Figure 13B:
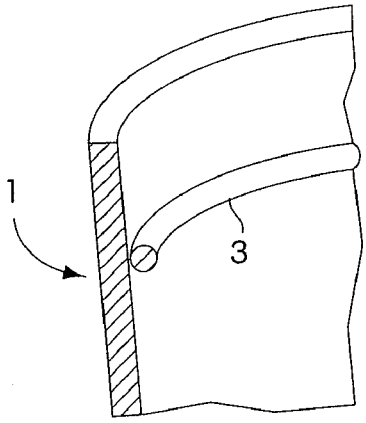

The liner frame 3 can be fabricated with fewer legs or if a container is designed with a way of attaching the frame to the inside of the container, then there can be fewer or shorter legs, or no legs required. As shown in FIGS. 9 and 10, the liner frame 3 can consist of a ring with short legs supported by an interior clips, sleeves, or support elements 6, 7 within or attached to the inside surface of the container 1. As shown in FIGS. 11 and 12, the legs may not be necessary, if the container is designed to have an interior lip or ridge, or an interior protrusion 8, which supports the frame. As shown in FIG. 13, a tapered shape of the container can also support the frame, without legs.

Figure 14:
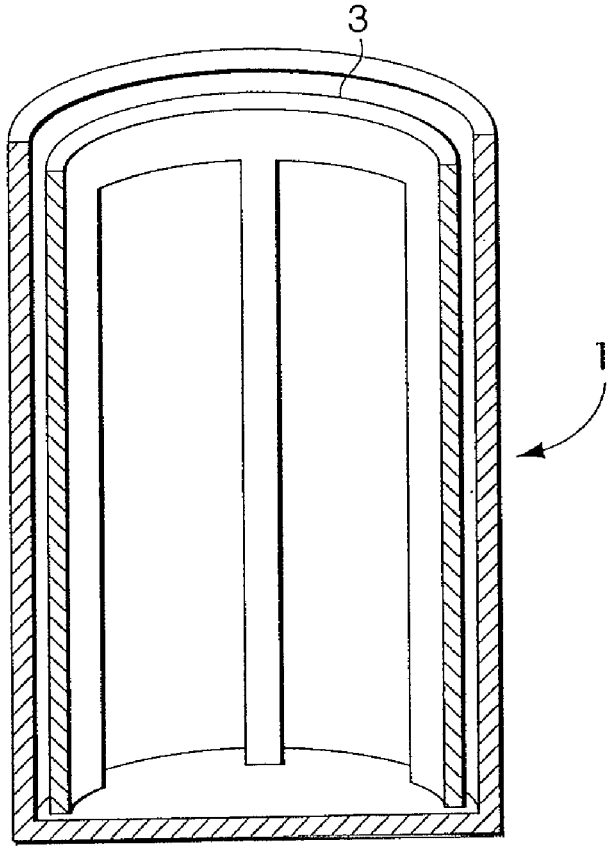
FIG. 14 shows an alternative embodiment (cross section view of the container) of the present invention where the liner support is in the form of a flat material with portions removed such that it resembles a frame when formed in tube or cylinder.
Figure 15:
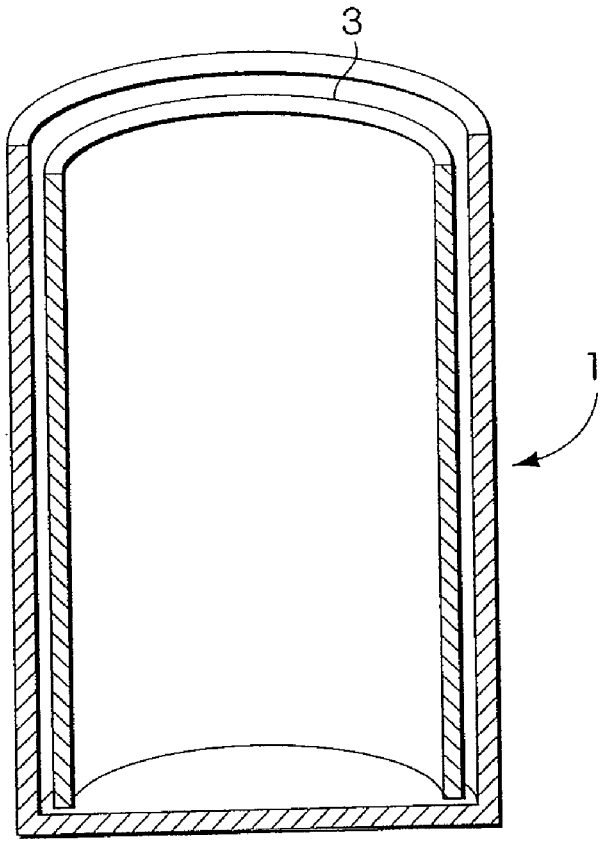
FIG. 15 shows alternative embodiment (cross section view of the container) of the present invention where the liner support is in the form of a flat material and formed in tube or cylinder.

In an alternative embodiment, the liner support 3 can be formed from a solid tube or cylinder (as shown in FIG. 15) or a solid tube or cylinder wherein a selected portion or portions of the solid material have been removed (as shown in FIG. 14) forming a frame similar to that shown in FIGS. 2–6. The liner support 3 can be formed from a solid tube or cylinder and optionally, the select portions removed or the liner support 3 can be formed, such as by molding, wherein the select portions are absent. In addition, the bottom of the liner support 3 can be connected (as shown by dashed lines) the same way the upper portion is connected in order to increase rigidity or for ease of use, so the device is symmetrical and cannot be installed upside-down. This embodiment can be made of plastic, metal, ceramic or composite materials and formed from a sheet or by molding.

The embodiment of the invention in FIG. 15 could also be fabricated by starting with a flat sheet material, such as sheet metal or sheet plastic, and then joining two edges of the sheet to form a tube or cylinder that makes up the liner support frame 3. Where the container is square, rectangular or otherwise polygonal in shape, the liner support can be creased or bent to the appropriate sized square, rectangular or polygonal shape.

In operation, instead of draping the plastic liner bag over the edge of the garbage can, as in the method of the prior art, the bag is draped 10 over the horizontal part of the frame 3 corresponding to the opening of the container, and partially over the vertical or semi-vertical support legs (if present in the embodiment). Preferably, the overlap 10 is at least 2 inches, although one of ordinary skill will appreciate that more or less overlap 10 may be used depending upon the application. Then the entire assembly is inserted into the garbage can. Preferably, the outer dimension of liner support frame 3 is 0.5 to 0.25 inches smaller than the inner dimension of the container 1 to provide a 0.25 to 0.125 clearance space between the liner support frame 3 and the container 1. In the embodiments shown in FIGS. 9–13 the clearance space can approach zero. In the embodiment such as that shown in FIGS. 11–13, liner support 3 can be sized to create an interference fit within the container 1, thus pinching the liner against the inside surface of the container. An internal groove (not shown) can be provided in the container 1 to maintain the liner support 3 at its intended position with respect to the top of the container.

When the plastic liner becomes filled with garbage, the frame 3 can be lifted up slightly over the opening of the garbage can, and the liner 2 is slipped through the liner frame 3. Alternatively, the liner 2 can be slipped and lifted out of the garbage can 1, and the liner bag 2 with garbage can be removed.

The liner frame 3 and the garbage can 1 is then ready to receive a new liner 2 to be inserted into the garbage can 1.

Accordingly, the present invention is a relatively easy to use and cost-effective device that can remedy the unsightly situation of plastic garbage liners draped over a garbage can in the method of the prior art.

The invention may be embodied in other specific forms without departing from the spirit or essential characteristics thereof. The present embodiments are therefore to be considered in respects as illustrative and not restrictive, the scope of the invention being indicated by the appended claims rather than by the foregoing description, and all changes which come within the meaning and range of the equivalency of the claims are therefore intended to be embraced therein.

What is claimed is:

1. An apparatus for supporting a liner entirely within a container, said container having an unobstructed opening defined by an inside top edge and having an oppositely disposed, substantially closed bottom, said apparatus comprising:

a liner support element fitted entirely inside said container at a position in close proximity to the inside top edge of the unobstructed opening of said container, wherein a liner supported by said liner support element is supported entirely within said container;

wherein the liner support element has an outer edge and said outer edge closely conforms to the inside top edge of said container along the full extent of the opening and wherein said outer edge of said liner support element substantially continuously supports along said full extent a liner which extends from inside said container and substantially continuously laps over said outer edge, wherein the lapped portion of the liner extends between the outer edge of the liner support element and the inside top edge of the container in intimate contact with the upper inside edge of the container, and thereby prevents waste materials from falling in between the liner and the inside top edge of the container, wherein the liner support element is supported by at least three legs, each leg extending from the top edge of the container along an inside surface of the container to the bottom of the container, each leg being coupled to said liner support element at a location substantially equally spaced around a peripheral portion thereof, with respect to each other leg, and wherein the liner support element is self-supporting within the container and is not supported by or engaged by attachment elements or supporting elements on an inside vertical surface of the container.

2. The apparatus of claim 1 wherein said container defines an inner surface at said position adjacent the top edge of the opening and the liner support element is adapted to conform to at least a portion of said inner surface.

3. The apparatus of claim 1 wherein the liner support element is sufficiently small enough to fit inside the inside top edge of the container and sufficiently large enough to prevent objects intended to be placed in the container from falling between the liner support element and the inside top edge of the container.

4. The apparatus of claim 1 wherein said liner support element is round, said opening of said container is round and said liner support element is adapted to be positioned adjacent the round opening of the container.

5. The apparatus of claim 1 wherein the liner support element is in the shape of a polygon, said opening of said container is in the shape of a polygon having at least as many sides as said liner support element, and said liner support element is adapted to be positioned adjacent the polygon shaped opening of the container.

6. The apparatus of claim 5 wherein the liner support element has four sides and polygon shaped opening of the container has at least four sides.

7. The apparatus of claim 1 wherein the liner support element is formed from a substantially thin material and is substantially the same thickness in a vertical dimension and a horizontal dimension.

8. The apparatus of claim 7 wherein said at least one leg includes at least a portion formed by twisting at least two wires around themselves.

9. The apparatus of claim 7 wherein said at least one leg includes at least a portion formed from a substantially straight piece of material.

10. The apparatus of claim 9 wherein the straight piece of material is selected from the set of materials comprising metals, plastics, composites and ceramic materials.

* * * * *